United States Patent [19]

Watkins

[11] 4,193,257

[45] Mar. 18, 1980

[54] PROGRAMMABLE METRONOME

[76] Inventor: Paul F. Watkins, 5551 Montgomery Square Dr. #102, Kettering, Ohio 45440

[21] Appl. No.: 959,353

[22] Filed: Nov. 9, 1978

[51] Int. Cl.[2] ..... G04F 5/02; A63J 17/00; G10B 15/00

[52] U.S. Cl. ..... 84/484; 84/464 R; 340/384 E

[58] Field of Search ..... 58/130 E; 84/464, 484; 340/384 E

[56] References Cited

U.S. PATENT DOCUMENTS

| | | | |
|---|---|---|---|
| 4,014,167 | 3/1977 | Hasegawa et al. | 84/484 |
| 4,018,131 | 4/1977 | Cannon | 58/130 E |

*Primary Examiner*—Edith S. Jackmon
*Attorney, Agent, or Firm*—Biebel, French & Nauman

[57] ABSTRACT

A programmable metronome includes two variable rate time pulse generators (10 and 12) which are alternatively used, audible and visible transducers including separate visible transducers (MM and Downbeat), and a tone transducer (55) capable of emitting different sounds for beats and downbeats.

A divider circuit (40) receives pulses from the generators. Selectors (61 and 62) connected between the divider and the transducers pass different numbers of pulses per measure from the active generator to the transducers according to manual selection of desired beats/measure. A downbeat emphasis circuit (56, 57) adds emphasis to each downbeat in a measure of beats. Each generator can be preset individually to a different metronome beat desired, and these are shown in numerical dipslays (66 and 67). The tone output of the audible transducer can be modified, and external output connections are provided for remote audible and visible transducers. The cadence selectors also display the numerators of different musical time signatures, corresponding to different positions of said selector means.

6 Claims, 4 Drawing Figures

20
22
23
24
25
26
27
28
29
30
31
32
33
34
35
36
37
4043
4081
OFF
4001
41
TO FIG. 1B
46
ON
+5V
43
44
45
47
48
49
50
51
52
53
TO MM LAMPS
+5V
42

PROGRAMMABLE METRONOME

BACKGROUND OF THE INVENTION

The invention relates to a programmable metronome which is useful as a practice and/or teaching aid for individuals and musical groups, providing quickly a large variety of cadences at different tempos, and having the ability to change either cadence (time signature) or tempo (mm) instantaneously, or according to some program.

Typical prior art devices are disclosed in U.S. Pat. Nos. 2,325,764, 2,195,255, 2,522,492, 3,038,120, 3,467,959, 3,541,916, 3,550,117, 3,595,122, and 3,643,540. However, no device of this type, other than the one hereafter, disclosed, is today commercially available. This seems to be the result of a combination of market demand, and lack of operating ease and overall adaptability on the part of prior art metronome devices in general.

SUMMARY OF THE INVENTION

The present invention provides a versatile programmable metronome comprising a time pulse generator, preferably two independent generators, and audible and visible transducers including separate lights for beats and downbeats, and a tone generator capable of emitting different sounds for beats and downbeats. A divider receives pulses from the generator, a selector is connected between the divider and the transducers, operable to pass different numbers of pulses per measure from the generator to the transducer according to manual selection of desired beats/measure, and a downbeat emphasis circuit adds emphasis to each downbeat in a measure of beats. Other feature of the metronome including a means for modifying the tone output of the tone generator, external output connections for remote audible and visible transducers, and a numerical display showing the numerators of different musical time signatures corresponding to different positions of the selector.

Each time pulse generator has a separate and independent selector associated therewith, and a switch is arranged to connect the individual selectors alternatively to the transducers.

DESCRIPTION OF PREFERRED EMBODIMENT

Figure 1A:
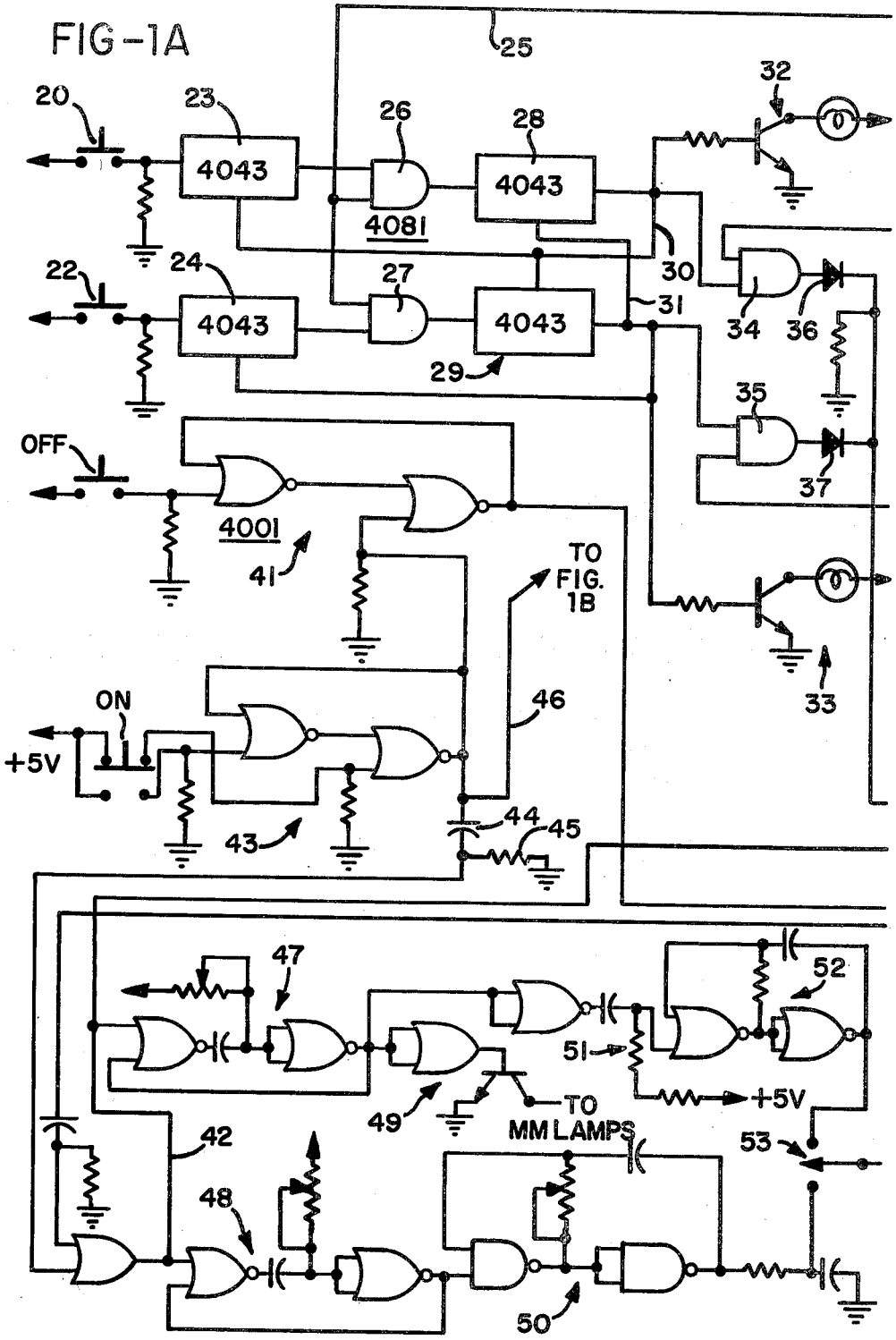
FIGS. 1A and 1B together are a schematic diagram of the control, pulse generating, and timing circuits.

The metronome incorporates two independently adjustable time pulse generators, 10 and 12 (beats/minute or mm), each associated with a three digit digital display 14 or 16, which indicates the cadence selected by an operator for each generator. The unit produces a light flash for each beat, a different type of light flash for each downbeat, a tone for each beat and a different type of tone for each downbeat, as explained hereafter.

The desired generator is selected by momentarily pressing the corresponding select buttons 20 for generator 10 or 22 for generator 12. Such depression sets corresponding latches 23 or 24, and these tell the system which time base is desired next. At the next downbeat, line 25 is pulsed (as later explained) and the appropriate gate 26 or 27 provides a set pulse to a corresponding latch 28 or 29. Latches 28 or 29 are cross coupled (by lines 30 and 31) to make them mutually exclusive. Thus one generator can be operating while the other is being set, and the desired one can be switched on rapidly.

Indicators and drivers 32 and 33 are provided to show the current time generator in use by lights 20A and 22A. Gates 34 and 35 and diodes 36 and 37 select time generator 10 or 12 respectively, according to the actuated latches.

The generators run at a rate sixty-four times the output (metronome or mm) beat. This facilitates counting for the panel displays 14 and 16, and ease of fabrication and calibration of the time generator circuits. A divider means is provided by a digital divider counter 40 which divides the clock rate by sixty-four to bring it down to the metronome rate delivered to the user by flashing lights and/or audible tones. Divider 40 is reset by an "off" latch 41 to inhibit output on a continuous basis or is pulsed to reset (line 22) on downbeat to make the first beat identical with future beat intervals.

A debounce switch circuit 43 starts the unit, resetting counter 40 by means of differentiating capacitor 44 and resistor 45, this switch initiation also pulses line 46 which provides a downbeat on start.

Pulses on line 42 initiate monostable multivibrators 47 and 48 which respectively provide pulses long enough to pulse visible transducers in the form of the metronome panel lights MM (through amplifier 49), and provide a beep duration pulse for aural metronome beats, by enabling beep frequency oscillator 50. The metronome monostable 47 also drives circuitry, consisting of a differentiating network 51 and a stable oscillator 52, which produces a short duration high pitched burst simulating a woodblock sound, thereby providing a modified tone output.

Figure 3:
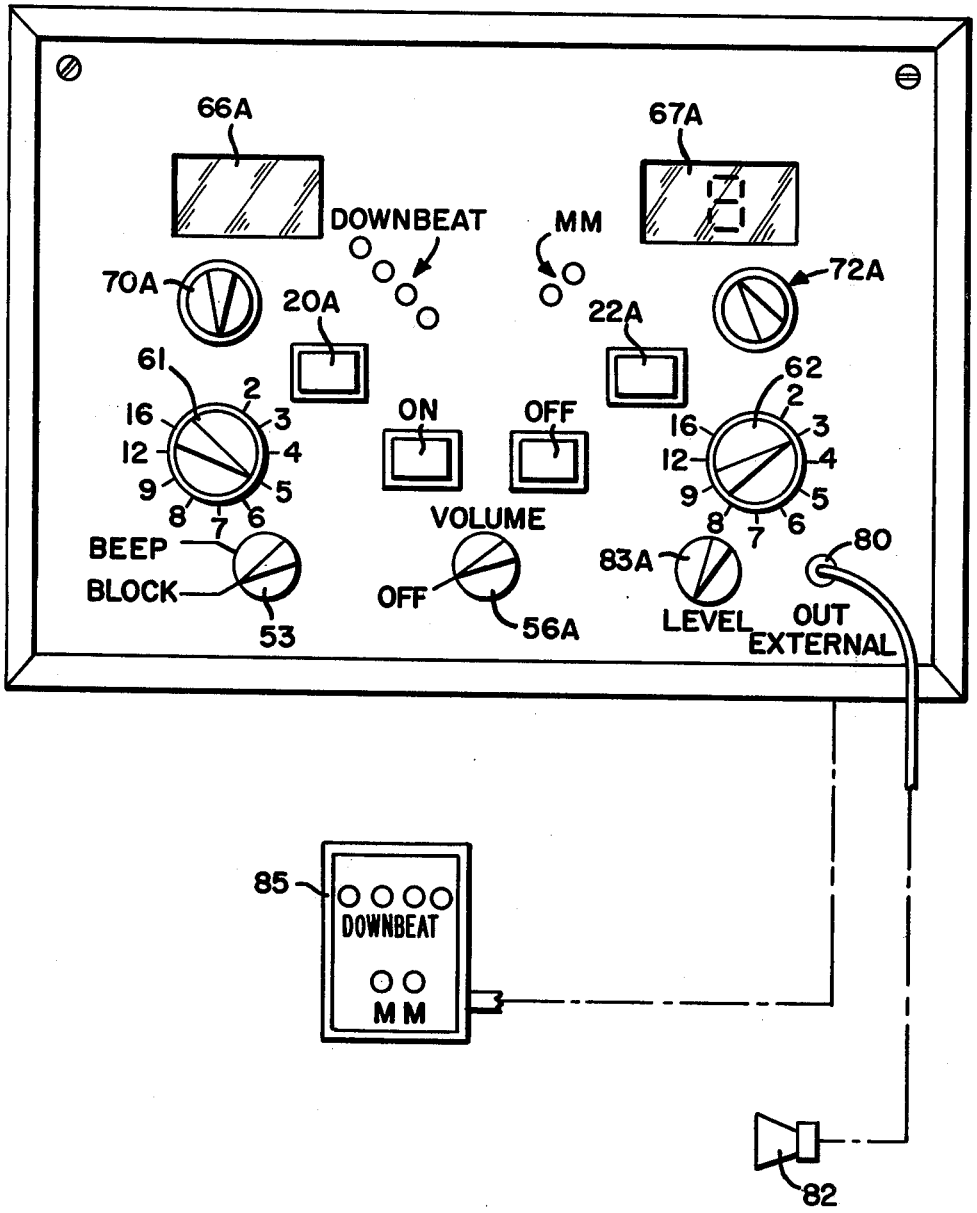
FIG. 3 is a frontal view of the housing showing manual controls and visible displays.

The beep or woodblock sounds are selected by a front panel switch 53, which constitutes a selector means, and are then ultimately fed to amplifier 54 and presented to the user through speaker 55. In the input to amplifier 54, resistor network 56 and diode 57 combine to form an attenuator of either tone during each beat. During each downbeat, the monostable 58 is enabled and diode 57 ceases to conduct, providing an emphasis arrangement and thereby making the downbeat beep (or woodblock click) louder. This differentiates the downbeat from regular metronome audio pulses. An additional monostable 59 and driver amplifier 60 pulse panel lamps which indicate downbeat (FIG. 3). There are more downbeat lamps than MM lamps, to differentiate between the two; this can also be accomplished with difference in color or intensity.

Figure 1B:
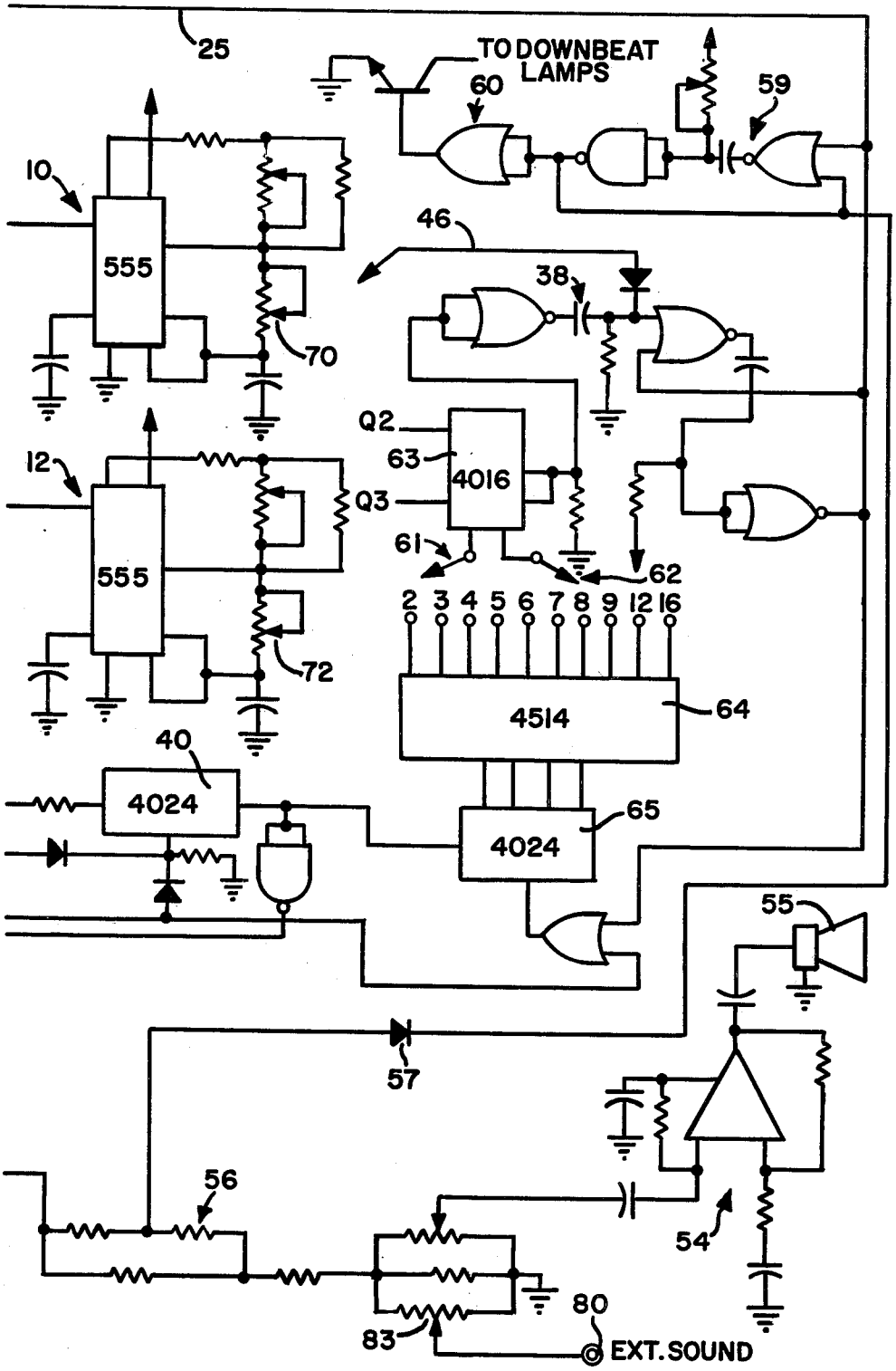
Figure 2:
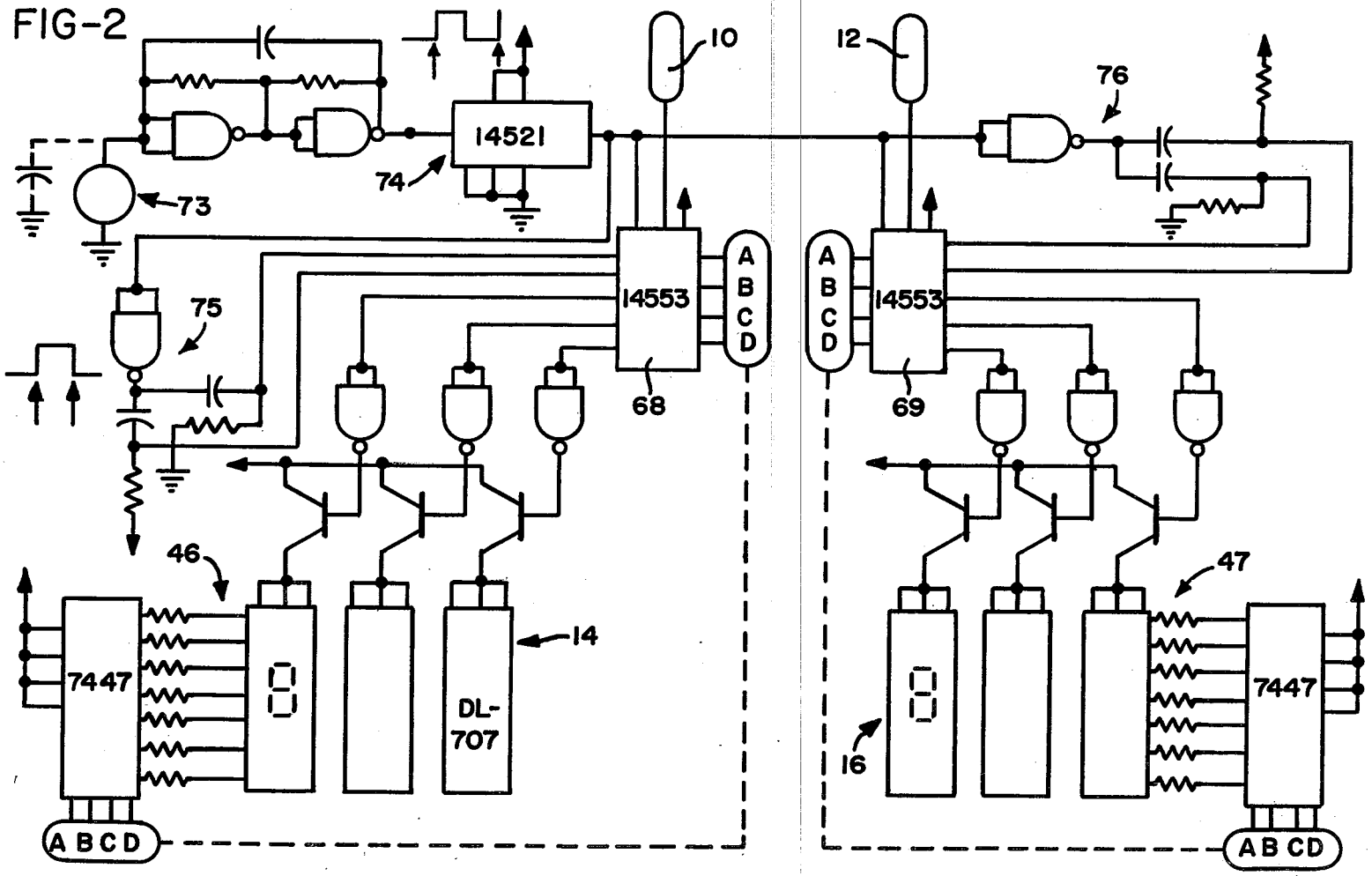
FIG. 2 is a diagram of the display and associated driving circuits.

The actual beat/measure selection is provided by selector means, namely front panel switches 61 and 62 (FIG. 3) shown in FIG. 1B as the wipers associated with clock generators 10 and 12, respectively. An analog switch 63 selects which switch wiper is connected to the downbeat start circuitry 58. Thus, if the current time base is from generator 10, $Q_2$ pin of switch 63 is high and the wiper 61 is selected. Tempo changes are made by the potentiometer controls 70 and 72 on the generators 10 and 12.

The switch positions corresponding to 2, 3, 4, 5, 6, 7, 8, 9, 12 and 16 Beats/Measure are connected to the appropriate outputs of a decoder 64 which is driven by a counter 65, its data being incremented at the metronome rate. The panel display (FIG. 3) includes multiplexed three digit display circuitry 66 and 67 for the two mm rates. The data for these displays is derived from three digit counters/multiplexers 68 and 69, respectively.

The inputs to circuits 68 and 69 are provided by the clock generators 10 and 12, while the accurate counting period of 1.06666 seconds is provided by a ceramic resonator oscillator 73 and divider circuitry 74. At the end of each counting period reset circuitry 75 and 76 sequentially updates the displays and resets the counters. By counting exactly 1.06666 seconds and operating clocks 10 and 12 at sixty-four times the metronome rate, the display is numerically equal to the beats/minute or metronome.

The controls of the metronome as appear to an operator are shown in FIG. 3. The digital displays are located behind windows 66A and 67A, and the controls for the corresponding generators appear therebeneath. The "on" and "off" switches are so labelled, along with the switches A and B which correspond to the generator selector switches 20 and 22. The beat/measure selector switches are shown at 61 and 62, with appropriate scales thereon, and can quickly be reset to prepare for an upcoming cadence change. The tempo controls 70A and 72A set the tempo desired from each of the generators, which appear in numerical form at the windows 66A and 67A. On the lower end of the panel are the beep-woodblock selector switch 53, a volume control 56A which is incorporated in the output of the attenuator circuit 56 to amplifier 54, and which includes a sound control switch which can turn off the audible part of the metronome if desired.

The external sound jack 80 provides a connection for a remote sound transducer or speaker 82, under control of a separate level potentiometer 83 and its knob 83A. There are also provisions for external visual transducers, in a small housing 85, which can be driven at the same beat/measure rates as the main downbeat and mm lamps.

While the form of apparatus herein described constitute preferred embodiment of this invention, it is to be understood that the invention is not limited to this precise form of apparatus, and that changes may be made therein without departing from the scope of the invention which is defined in the appended claims.

What is claimed is:

1. A programmable metronome comprising a variable rate time pulse generator, means for setting the rate of said time pulse generator, audible and visible transducer means including separate visible transducers for beats and downbeats and a tone generator capable of emitting different sounds for beats and downbeats, divider means receiving pulses from said time pulse generator, selector means connected between said divider means and said transducer means and operable to pass different numbers of pulses per measure from said time pulse generator to said transducer means according to manual selection of desired beats/measure, and a downbeat emphasis circuit having an input from said selector means and an output to said downbeat transducer means to add emphasis to each downbeat in a measure of beats.

2. A metronome according to claim 1, including means for modifying the tone output of said tone generator.

3. A metronome according to claim 1, including external output connections for remote audible and visible transducers.

4. A metronome according to claim 1, including means incorporated in said selector means displaying the numerators of different musical time signatures corresponding to different positions of said selector means.

5. A metronome according to claim 1, including a numerical display driven by said time pulse generator to show the rate at which the time pulse generator is operating.

6. A metronome according to claims 1, 2, 3, 4, or 5, including two independent time pulse generators, each time pulse generator having a separate and independent selector means and numerical display associated therewith, switch means arranged to connect the individual selector means alternatively to said transducer means.

* * * * *